US005413047A

United States Patent [19]

Evans et al.

[11] Patent Number: 5,413,047

[45] Date of Patent: May 9, 1995

[54] OVERBURDEN REMOVAL METHOD WITH BLAST CASTING AND EXCAVATING APPARATUS

[75] Inventors: Randall N. Evans, Upton; Monica S. Cummins; Marlyn G. King, both of Gillette; Robert L. Ferguson, Wright, all of Wyo.

[73] Assignee: Atlantic Richfield Company, Plano, Tex.

[21] Appl. No.: 137,681

[22] Filed: Oct. 15, 1993

[51] Int. Cl.[6] ..... F42D 3/00

[52] U.S. Cl. ..... 102/302

[58] Field of Search ..... 102/302

[56] References Cited

U.S. PATENT DOCUMENTS 5,140,907 8/1992 Syatek ..... 102/302

5,194,689 3/1993 Cummins ..... 102/302

*Primary Examiner*—Peter A. Nelson

*Attorney, Agent, or Firm*—Michael E. Martin

[57] ABSTRACT

Coal and other mineral seams are uncovered of overburden to a predetermined width by blast casting a portion of the overburden into an adjacent spoil pit followed by fragmentation blasting of the remaining width of the overburden panel. A dragline excavator is moved at least partially onto the fragmented overburden for excavating a keycut portion together with excavation to level the bench for an adjacent overburden panel and placement of the material on a temporary spoil pile.

6 Claims, 2 Drawing Sheets

OVERBURDEN REMOVAL METHOD WITH BLAST CASTING AND EXCAVATING APPARATUS

BACKGROUND OF THE INVENTION

1. Field of the Invention

The present invention pertains to a method for removing overburden in a surface mining operation using blast casting and blast fragmentation of the overburden together with mechanical excavation to reduce the overall excavating effort in exposing a coal or other mineral seam of substantial width.

2. Background

The time and effort required to move overburden material away from a mineral seam in the earth is important with respect to the efficiency of large scale surface mining operations, in particular. The development of ever larger mechanical excavating apparatus such as dragline type excavators has made available the opportunity to increase the width of a coal seam or similar mineral value that may be uncovered in one cycle of a typical surface mining method. However, the increased width of a so-called "panel" of overburden material that may be removed in one cycle of operation has given rise to certain problems in utilizing blast casting techniques and in fragmenting the overburden material in preparation for excavation. In particular, limits on the width of a panel of overburden material which may be blast cast into an adjacent pit have brought on the need for developing a method for uncovering relatively wide segments of coal and similar mineral seams. It is to this end that the present invention has been developed to provide an improved method for removing overburden from coal seams and similar excavating operations.

SUMMARY OF THE INVENTION

The present invention provides an improved method for excavating overburden material from a coal seam or a similar mineral seam in the earth.

In accordance with an important aspect of the present invention, a combination of blast casting, fragmentation blasting and mechanical excavating of overburden material is used to uncover a mineral seam, which seam has an increased width with respect to prior art surface mining operations and wherein the amount of material removed in one cycle of uncovering a seam is improved.

In accordance with the present invention, a so-called panel of overburden material of predetermined width is removed from above a mineral seam in such a way that a greater amount of material is moved to a final resting place in a spoil pile adjacent to the mineral seam in a timely manner and more efficiently than with prior art methods. An overburden "panel" of a predetermined, substantial width is prepared for excavation by drilling a predetermined pattern of blastholes at a predetermined angle with respect to the vertical in such a way as to provide for blast casting a significant portion of overburden material to an intermediate or final resting place. Approximately one half of the panel width is blast cast followed by preparation of the remaining half width of the panel for excavation by drilling a series of substantially vertical blastholes which are then suitably charged with explosive that fragments the material in the standing half of the overburden panel so that an excavating apparatus, such as a dragline, may be moved at least partially onto the fragmented portion of the overburden panel and more effectively utilized to excavate the overburden material. Placement of the excavating dragline on the fragmented material also permits use of the dragline to prepare a suitable bench adjacent to the panel being excavated in preparation for the next panel of overburden material to be subjected to the blast casting, fragmentation and excavating procedure.

Those skilled in the art will further appreciate the abovementioned advantages of the present invention together with other superior aspects thereof upon reading the detailed description which follows in conjunction with the drawing.

DESCRIPTION OF A PREFERRED EMBODIMENT

Figure 1:
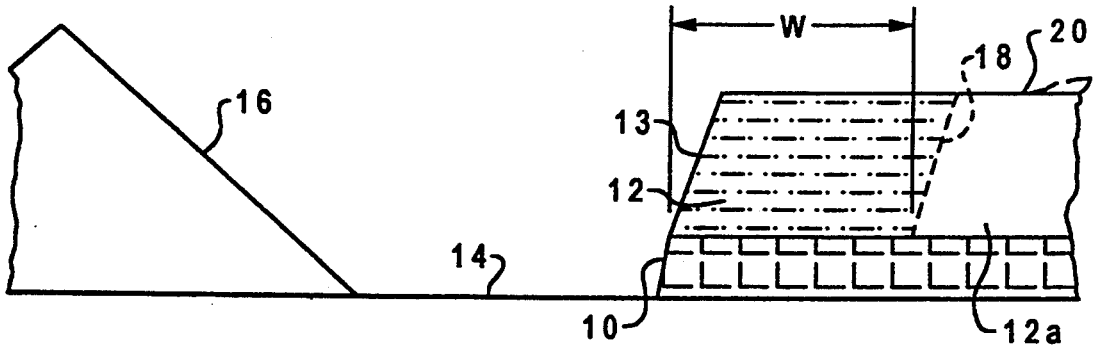
FIGS. 1 through 5 comprise schematic diagrams showing, sequentially, the steps in preparing and excavating overburden for removal from above a coal seam in a surface mining operation.

In the description which follows, like elements are marked throughout the specification and drawing with the same reference numerals, respectively. The drawing figures are not to scale and comprise essentially schematic diagrams illustrating the method of the invention.

U.S. Pat. No. 5,140,907 to Steven M. Svatek and U.S. Pat. No. 5,194,689 to Monica S. Cummins, both assigned to the assignee of the present invention, describe methods of earth excavation in surface mining operations using a combination of blast casting and mechanical excavation to uncover a mineral seam such as coal. Both of these patents are incorporated by reference herein. The Svatek patent describes a method wherein a predetermined pattern of blastholes is drilled in the overburden and a portion of the overburden is cast into a pit area adjacent to the coal seam to be uncovered. This operation is followed by excavation of the blast cast material which has not been completely cast into the pit area. One problem associated with the method described in the Svatek patent is that the substantial width of the seam to be uncovered and which may be uncovered, thanks to the development of large dragline type excavating apparatus, cannot be blast cast entirely to a suitable intermediate or final resting place using known blast casting techniques.

Still further, however, the material which is not completely blast cast into the so-called pit area is, in the Svatek method, loosened sufficiently and moved sufficiently that it is not possible to place a large dragline type excavator onto the blast cast material still remaining over the coal seam in a position wherein the material excavated may be deposited sufficiently far from the seam while still permitting the excavating apparatus to prepare an adjacent bench area for the next panel or seam width to be uncovered. It is to this end that the present invention has been developed with a view to improving the overburden movement methods described in the abovementioned patents.

Referring to FIG. 1, there is illustrated a coal seam 10, for example, which is in the process of being mined by uncovering predetermined widths of overburden material such as a so-called overburden panel 12 which has a predetermined width W over the seam 10, as indicated. A previously mined area or pit portion 14 is provided from excavation of the coal in a previous mining operation, and overburden material from the previous mining operation which created the pit 14 is shown disposed on a spoil pile 16. The width of coal seam W, which may be uncovered with one "pass" of an excavation apparatus, such as a large dragline excavator to be discussed in further detail herein, may be on the order of 250 to 270 feet and successive panels or widths of overburden 12 may be removed in successive passes of the excavating apparatus after the overburden has been prepared in accordance with the method of the invention. For example, the line 18 in FIG. 1 defines the new so-called high wall which will be created when the panel or width of overburden 12 is removed in accordance with the invention.

In the patents referenced hereinabove, the overburden material is indicated to be prepared for removal and substantially removed from on top of the coal seam by a practice known as blast casting. In blast casting, a predetermined pattern of blastholes is drilled, generally at an angle to the vertical, in the overburden material adjacent to the pit area 14 or a similar area where the material is to be deposited. The blastholes are then loaded with suitable explosive material and the material is detonated to actually cast the overburden material in the direction desired, such as into the pit 14. However, there are practical limits to the width of a quantity of overburden such as the overburden panel 12 which may be suitably blast cast into a new position. Blast casting is currently limited to a panel width of about 150 feet, for example. If greater widths of blast casting are attempted, the material may be rubblized but only partially cast, leaving a somewhat uneven or unstable sloping wall of material which may require excavation but which will place the excavation apparatus in an undesired position on the high wall, or the surface 20, as shown in FIG. 1, which will not permit suitable transfer of the material by an excavating apparatus into the pit area. It is to this end that a unique and improved method of excavating overburden has been provided for moving overburden panels such as the panel 12 to a final resting place.

Figure 2:
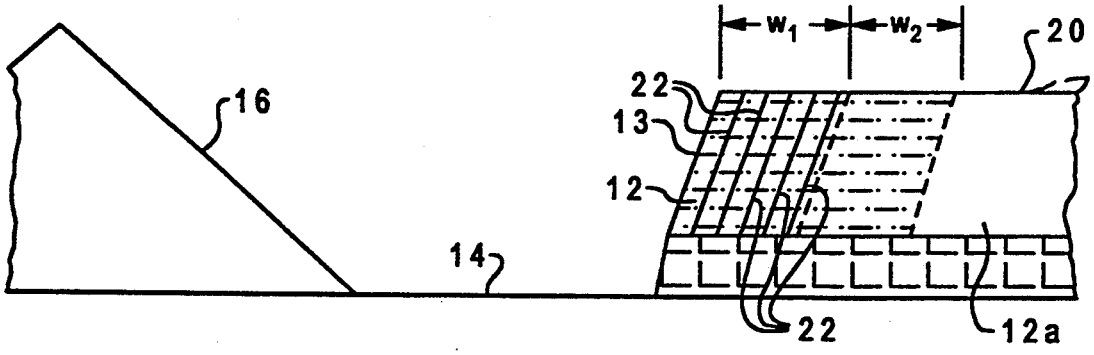

FIG. 2 illustrates the condition wherein the overburden 12 adjacent to high wall 13 has been drilled with a series of blast casting blastholes 22 having a predetermined spacing pattern both longitudinally, that is into the plane of the paper, and transversely, as illustrated. The blastholes 22 are typically drilled at an angle to the vertical of about 15 to 25 degrees. In accordance with the invention, a preselected width $W_1$ of the overburden 12 has been determined to be suitable for blast casting into the pit area 14. Typically, the width $W_1$ is on the order of about 150 feet. Although the excavating apparatus mentioned above and to be described in further detail herein is capable of excavating a panel of overburden material of width W on the order of about 260 feet, any effort to blast cast material of a width more than about that of $W_1$ would be unsuccessful yet would possibly substantially rubblize the remaining panel width $W_2$ and make it unsuitable for supporting an excavating apparatus in a position which would permit suitable excavation of the blast cast material as well as the material of width $W_2$ or material above the level of surface 20 and over the next panel to be excavated, such as the panel 12*a*.

Figure 3:
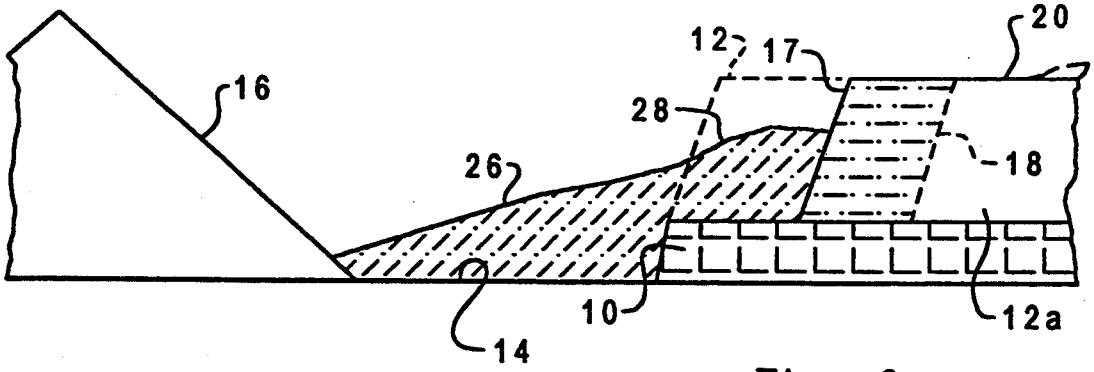

In accordance with the present invention, the width $W_1$ of the overburden panel 12 is blast cast into the pit area 14 to the position indicated in FIG. 3, for example. In FIG. 3, a substantial portion of the overburden material from the panel 12 of width $W_1$ has been cast into the pit area 14 as indicated by numeral 26. Some material remains resting on the coal seam 10 as indicated at 28 and an intermediate high wall 17 has been formed as indicated in FIG. 3.

Figure 4:
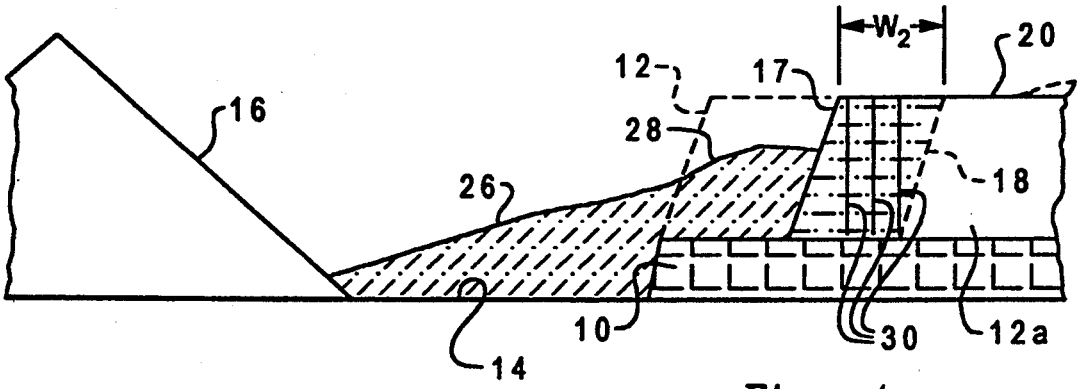

Referring now to FIG. 4, since it is desired to remove all of the overburden material back to the high wall 18 so that a coal seam of width W may be uncovered for eventual excavation, it has been determined that a predetermined pattern of generally vertical blastholes 30 may be drilled into the remaining portion of the overburden panel 12, within width $W_2$, and these blastholes are then suitably loaded with explosive material and detonated to fragment the material within width $W_2$ to improve the ability to mechanically excavate this material back to the high wall 18.

Figure 5:
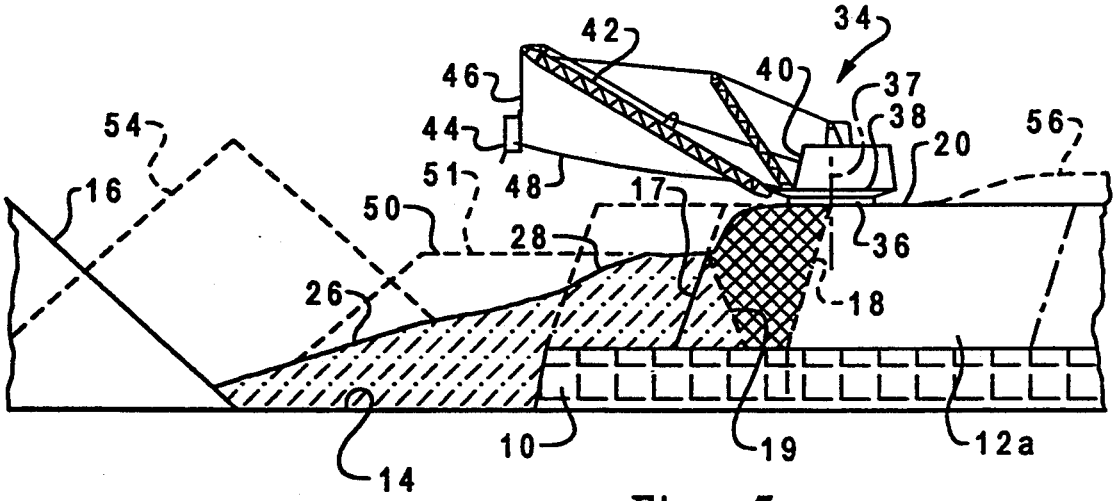

FIG. 5 illustrates the condition wherein the material between the high walls 17 and 18 has been fragmented and an excavating apparatus, generally designated by the numeral 34, has been moved into position, at least partially resting on the fragmented material between the high walls 17 and 18. The excavating apparatus 34 may be a dragline type excavator having a suitable support base or tub 36 on which is rotatably mounted a frame 38 including a machinery house 40 and main boom 42, all of which may pivot with respect to the base or tub 36 in a substantial arc about a pivot axis 37, for example. A conventional excavating bucket 44 is suitably supported by hoist and draglines 46 and 48.

By fragmenting the overburden material between the walls 17 and 18 without unduly rubblizing the material or casting the material toward the pit 14 a stable support is provided for the excavator 34 so that the excavator may rest at least partially on the fragmented material. In this way, the excavator 34 may begin excavating material disposed on the coal seam 10 to begin forming an intermediate spoil pile, generally outlined by the dashed line 50 in FIG. 5. This excavated material will be derived at least in part from a so-called keycut portion between the high wall 18 and an intermediate wall 19 in FIG. 5. The top surface 51 of the intermediate spoil pile 50 may be leveled, as indicated in the diagram of FIG. 5, by suitable equipment, not shown, so that upon removal of all of the material between the walls 18 and 19 to form the so-called keycut, the excavator 34 may be moved onto the surface 51 for final excavation of overburden material to place the material 28 inclusive into a final spoil pile 54. These last-mentioned steps of excavation with the excavator 34 may be carried out in accordance with the teaching of the aforementioned patents.

Additionally, by providing the fragmented overburden portion between the walls 17 and 18 and placing the excavator 34 in the position shown and described, the excavator may also be used to level the bench surface 20 by removing any overburden material such as indicated at 56 in FIG. 5. This operation provides a level bench surface over the next panel of overburden 12*a* to be removed in a succeeding operation to uncover a new portion of the coal seam 10 of width W, and using the method described herein. Accordingly, by partially cast blasting an overburden panel, such as the overburden 12 shown and described, and then, in a separate operation, fragmenting a portion of the overburden panel only sufficiently to allow a portion of the overburden panel to remain in place for partially supporting the excavator 34, as shown, a wider panel of overburden material and a greater width W of a coal seam may be uncovered using both blast casting and mechanical excavation.

A typical operation to uncover a coal seam in a surface mine, such as in the Powder River Basin of Wyoming, may be carried out wherein a pattern of blastholes 22 for cast blasting may be drilled through an overburden layer of approximately one hundred feet to two hundred feet thickness. The blastholes 22, preferably in a pattern spaced apart twenty two feet to twenty six feet in four or five rows spaced thirty feet to thirty five feet apart and drilled at an angle of fifteen degrees to twenty five degrees to the vertical, may be loaded with suitable explosive and the overburden material blast cast into the pit area 14, as indicated in FIG. 3. A second set of generally vertical blastholes comprising the holes 30 is then drilled in a pattern of holes spaced thirty feet to thirty five feet apart in plural rows spaced thirty two feet to thirty eight feet apart. Explosive is then loaded into the holes 30 and detonated to fragment the material between the high walls 17 and 18 without substantially displacing this material. Moreover, by blast casting a portion of an overburden panel of predetermined width to a lower elevation than that of the surface 20 followed by fragmenting another portion of the overburden panel and placing the excavator 34 at least partially on the fragmented portion, excavation of the keycut portion of the overburden between the walls 18 and 19 is carried out with reduced excavating effort while the excavator is in a position to level the surface 20 for the next panel of overburden to be removed. Accordingly, a coal seam of width W in the range of 250 to 270 feet is uncovered with savings in excavation work done by the dragline excavator apparatus 34 and a seam of width W may be uncovered in only two passes of the excavating apparatus along the length of the seam, one pass being to remove the keycut portion between the walls 18 and 19 and to form a level surface 20 for the next cycle to uncover the panel 12*a*. The other pass of the cycle of removing overburden panel 12 then excavates the temporary spoil pile 50 into the permanent spoil pile 54.

Although a preferred embodiment of the present invention has been described in detail herein, those skilled in the art will recognize that various substitutions and modifications may be made to the method without departing from the scope and spirit of the invention as recited in the appended claims.

What is claimed is:

1. A method for removing overburden from a mineral seam in the earth comprising the steps of:

determining a seam width to be uncovered of said overburden material;

predetermining a portion of said seam width covered by overburden to define an overburden panel which may be blast cast into a pit area adjacent to said seam;

drilling a predetermined pattern of blastholes into said overburden to receive explosive charges and blast casting said overburden from over said predetermined portion of said seam width;

drilling a predetermined pattern of substantially vertical blastholes in the remaining portion of said overburden over said seam width and blast fragmenting said remaining portion of said overburden by detonating explosive charges in said substantially vertical blastholes; and placing an excavating apparatus at least partially on said fragmented portion of said overburden and excavating overburden from above said seam.

2. The method set forth in claim 1 including the step of:

excavating overburden material from another overburden panel adjacent to said overburden panel of predetermined width to form a substantially horizontal bench surface for said excavating apparatus.

3. The method set forth in claim 1 wherein:

overburden material excavated from above said seam is placed in a temporary spoil pile adjacent said seam.

4. The method set forth in claim 3 including the step of:

moving overburden material to form a generally horizontal pad surface on said temporary spoil pile at an elevation lower than that of unblasted overburden.

5. A method for removing overburden from a coal seam in the earth, comprising the steps of:

determining a portion of said seam having a width not less than about 250 feet;

determining a first portion of said overburden over said portion of said seam having a width not greater than about 150 feet;

drilling a first set of blastholes at an angle from the vertical in said first portion of said overburden and blast casting said first portion of said overburden toward a pit area adjacent said seam;

drilling a second set of substantially vertical blastholes in a second portion of said overburden over said portion of said seam and blast fragmenting said second portion of said overburden; and placing a dragline excavator at least partially on said second portion of said overburden and excavating material from said second portion of said overburden to form a spoil pile.

6. The method set forth in claim 5 including the step of:

excavating overburden material from another overburden panel adjacent to said overburden panel of predetermined width to form a substantially horizontal bench surface for said excavating apparatus.

* * * * *